US009068758B2

(12) United States Patent
Matsuura et al.

(10) Patent No.: US 9,068,758 B2
(45) Date of Patent: Jun. 30, 2015

(54) REFRIGERANT DISTRIBUTION UNIT FOR AIR CONDITIONER

(75) Inventors: Shun Matsuura, Kawasaki (JP); Haruki Yamashita, Kawasaki (JP)

(73) Assignee: FUJITSU GENERAL LIMITED, Kawaski-shi (JP)

( * ) Notice: Subject to any disclaimer, the term of this patent is extended or adjusted under 35 U.S.C. 154(b) by 705 days.

(21) Appl. No.: 13/166,614

(22) Filed: Jun. 22, 2011

(65) Prior Publication Data

US 2012/0000227 A1 Jan. 5, 2012

(30) Foreign Application Priority Data

Jun. 30, 2010 (JP) ..... 2010-148523

(51) Int. Cl.

| | |
|---|---|
| ***F25B 5/00*** | (2006.01) |
| ***F25D 21/14*** | (2006.01) |
| ***F25B 39/02*** | (2006.01) |
| ***F24F 1/32*** | (2011.01) |
| ***F24F 1/26*** | (2011.01) |
| ***F24F 1/34*** | (2011.01) |
| ***F25B 41/00*** | (2006.01) |

(52) U.S. Cl.

CPC ... *F24F 1/32* (2013.01); *F24F 1/26* (2013.01); *F24F 1/34* (2013.01); *F25B 41/003* (2013.01)

(58) Field of Classification Search

CPC ..... F24F 1/26; F24F 1/32; F24F 1/34; F25B 41/003

USPC ..... 62/200

See application file for complete search history.

(56) References Cited

U.S. PATENT DOCUMENTS 6,135,810 A * 10/2000 Damson et al. ..... 439/501
6,248,952 B1 * 6/2001 Reeves et al. ..... 174/663

(Continued)

FOREIGN PATENT DOCUMENTS

CN 1171520 A 1/1998
CN 1540255 A 10/2004

(Continued)

OTHER PUBLICATIONS

Notification of the First Office Action issued in Chinese Patent Application No. 201110183307.6 dated Jul. 1, 2014.

Office Action issued in Japanese Patent Application No. 2010-148523 dated Aug. 27, 2013.

*Primary Examiner* — M. Alexandra Elve

*Assistant Examiner* — Henry Crenshaw

(74) *Attorney, Agent, or Firm* — Venable LLP; Michael A. Sartori; F. Brock Riggs

(57) ABSTRACT

A refrigerant distribution unit for an air conditioner, includes: a pipe unit which distributes a refrigerant from a refrigerant pipe on an outdoor unit side to multiple branch refrigerant pipes, which includes an electromagnetic valve and a temperature sensor, on an indoor unit side; a main unit which stores the pipe unit covered by an insulator case, upper and lower cases; and an electric component box which controls the electromagnetic valves and the temperature sensors by connecting the valves with the sensors by cables. A cable draw-out recessed portion is formed in one of side faces of the insulator case where the connecting slots for the pipes are formed, and a bottom face recessed portion for storing the cables is formed in a bottom face of the insulator case. The upper case includes a cable draw-out slot for guiding the cables to a cable guide hole formed in the electric component box.

4 Claims, 11 Drawing Sheets

(56) References Cited

U.S. PATENT DOCUMENTS

| | | | | |
|---|---|---|---|---|
| 7,825,337 | B2 * | 11/2010 | Young, IV | 174/72 A |
| 2003/0102143 | A1 * | 6/2003 | Sato et al. | 174/65 G |
| 2006/0110120 | A1 * | 5/2006 | Noseda et al. | 385/135 |
| 2007/0274659 | A1 * | 11/2007 | Kaplan | 385/134 |
| 2008/0131067 | A1 * | 6/2008 | Ugolini et al. | 385/135 |
| 2008/0193096 | A1 * | 8/2008 | Jones et al. | 385/135 |
| 2008/0237420 | A1 * | 10/2008 | Wayman et al. | 248/220.21 |

FOREIGN PATENT DOCUMENTS

| | | | | |
|---|---|---|---|---|
| CN | 2703986 | Y | 6/2005 | |
| JP | 09-280722 | A | 10/1997 | |
| JP | H09-280722 | * | 10/1997 | F25D 23/00 |
| JP | 2004-085003 | A | 3/2004 | |
| JP | 2006-300381 | * | 11/2006 | F24F 5/00 |
| JP | 2006-300381 | A | 11/2006 | |
| KR | 100526105 | B1 | 11/2005 | |

* cited by examiner

REFRIGERANT DISTRIBUTION UNIT FOR AIR CONDITIONER

This application claims priority from Japanese Patent Application No. 2010-148523, filed on Jun. 30, 2010, the entire contents of which are hereby incorporated by reference.

FIELD OF THE INVENTION

The present disclosure relates to a refrigerant distribution unit for an air conditioner which is used to distribute a refrigerant from an outdoor unit of the air conditioner to multiple indoor units thereof. Specifically, the present disclosure relates to enhanced safety and enhanced efficiency of an installation operation of the refrigerant distribution unit.

DESCRIPTION OF RELATED ART

As a refrigerant distribution unit for distributing a refrigerant from an outdoor unit of an air conditioner to multiple indoor units thereof, for example, as disclosed in Japanese Patent Application Publication No. JP-A-2006-300381, there is known a refrigerant distribution unit which is capable of changing an installation surface of an electric component box according to an installation site of the refrigerant distribution unit with a main unit of the refrigerant distribution unit and cables remaining connected to each other.

However, in JP-A-2006-300381, since the cables of the refrigerant distribution unit are drawn out from the main unit to the outside, are moved around the main unit and are connected to an electric component box, there is a fear that an operator can touch the cables.

In view of this, there has been demanded the development of a refrigerant distribution unit for an air conditioner which can change an installation surface of an electric component box with a main unit and cables of the refrigerant distribution unit remaining connected to each other to thereby be able to enhance the efficiency of the installation operation of the refrigerant distribution unit, and also in which, after installation, the cables can be stored within the main unit to thereby be able to secure the safety of an operator who operates the refrigerant distribution unit.

SUMMARY OF INVENTION

According to a first aspect of the invention, a refrigerant distribution unit for an air conditioner, is provided with: a pipe unit which distributes a refrigerant from a refrigerant pipe provided on an outdoor unit side to a plurality of branch refrigerant pipes provided on an indoor unit side, each of the plurality of branch refrigerant pipes including an electromagnetic valve and a temperature sensor; a main unit which stores the pipe unit in such a manner that the pipe unit is covered by an insulator case, an upper case and a lower case; and an electric component box which controls the electromagnetic valves and the temperature sensors by connecting the electromagnetic valves with the temperature sensors by cables. The insulator case includes a side face where a first connecting slot for connecting the refrigerant pipe is formed and a side face where a second connecting slot for connecting the plurality of branch refrigerant pipes is formed. A cable draw-out recessed portion for drawing out the cables from the pipe unit is formed in one of the side faces where the first and second connecting slots are formed, and a bottom face recessed portion for storing the cables is formed in a bottom face of the insulator case. The upper case includes a cable draw-out slot for guiding the cables from the bottom face recessed portion to a cable guide hole formed in the electric component box.

Other aspects and advantages of the invention will be apparent from the following description, the drawings and the claims.

BRIEF DESCRIPTION OF THE DRAWINGS

FIG. 10 shows a state of the electric component box in which the electric component box is mounted on a right side surface of the refrigerant distribution unit when viewed from an outdoor unit side of the air conditioner, with a lower case removed from the electric component box. Specifically.

FIG. 11 shows a state of the electric component box in which the electric component box is mounted on a left side surface of the refrigerant distribution unit when viewed from the outdoor unit side of the air conditioner, with the lower case removed therefrom. Specifically.

DETAILED DESCRIPTION OF EXEMPLARY EMBODIMENTS

Now, description will be given below specifically of the best mode for carrying out the invention, using the embodiments thereof with reference to the accompanying drawings.

Exemplary Embodiment 1

Air Conditioner

Figure 1:
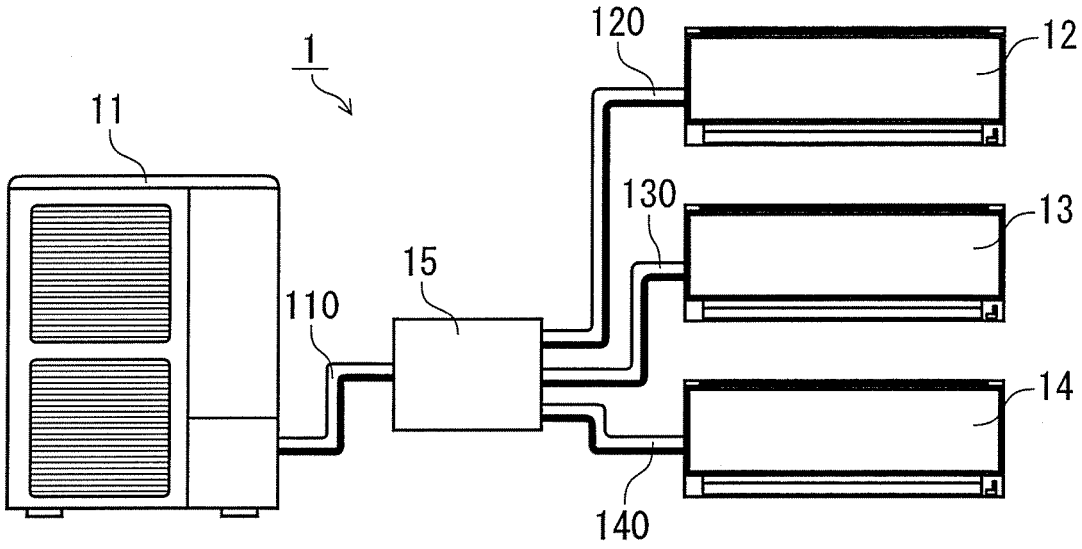
FIG. 1 is a schematic structure view showing an air conditioner according to an exemplary embodiment of an invention.

An air conditioner 1 shown in FIG. 1 includes an outdoor unit 11, and multiple indoor units 12, 13, 14.

The outdoor unit 11 includes the following composing parts (none of which are shown): that is, a portion of refrigerant circuits respectively for an outdoor heat exchanger, a compressor, a four way valve and the like; a fan for blasting air in order to exchange heat between a refrigerant within the outdoor heat exchanger and the open air; a fan motor for driving the fan; and, a control circuit for controlling the above composing parts.

The indoor units 12, 13 and 14 respectively include the following composing parts (none of which are shown): that is, a portion of refrigerant circuits respectively for an indoor heat exchanger and the like; a fan for blasting air in order to exchange heat between a refrigerant within the indoor heat exchanger and the open air; a fan motor for driving the fan; and, a control circuit for controlling the above composing parts.

The refrigerant circuit of the outdoor unit 11 is connected to the refrigerant circuits of the indoor units 12, 13 and 14 through an outdoor-unit-side pipe 110 and indoor-unit-side pipes 120, 130 and 140 respectively. Between the outdoor unit 11 and the multiple indoor units 12, 13 and 14, there is provided a refrigerant distribution unit 15 which is used to distribute a refrigerant uniformly from the outdoor-unit-side pipe 110 to the indoor-unit-side pipes 120, 130 and 140.

<Refrigerant Distribution Unit>

Figure 2:
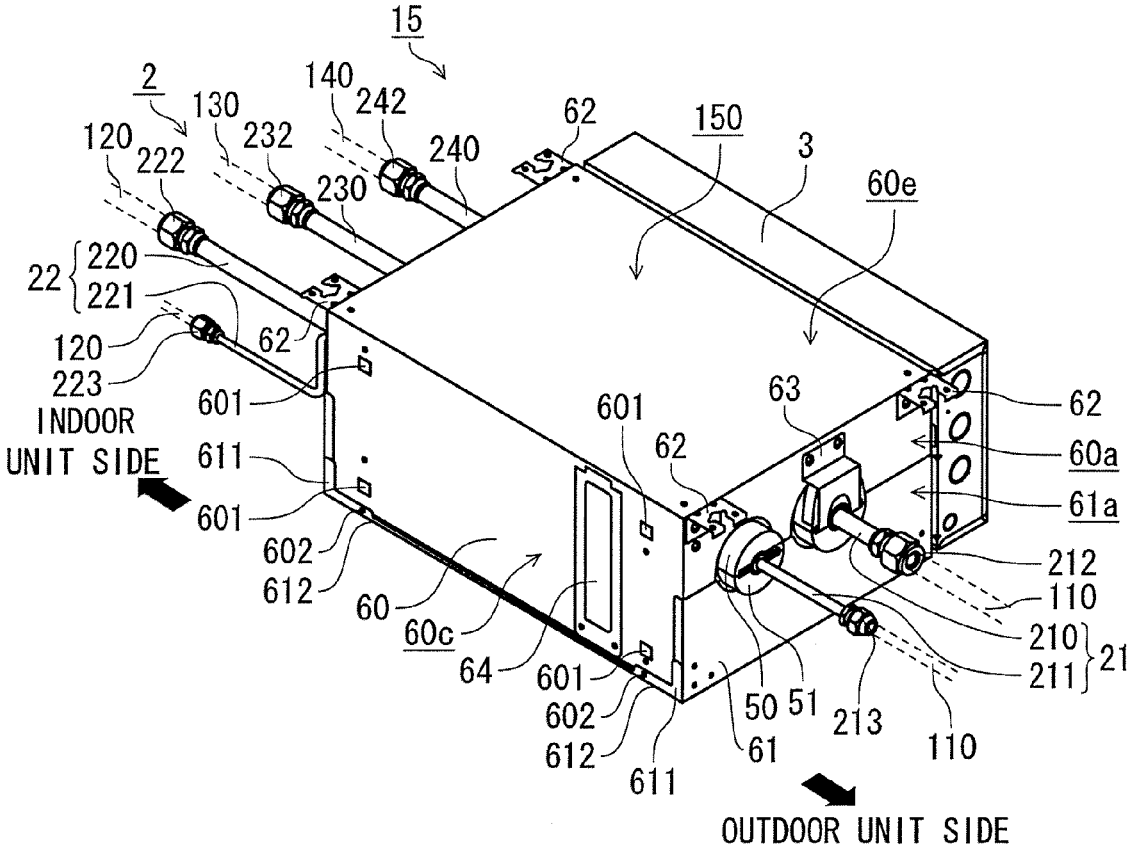
FIG. 2 is a perspective view showing a refrigerant distribution unit according to the exemplary embodiment.

The refrigerant distribution unit 15 shown in FIG. 2 includes: a pipe unit 2 for connecting the outdoor-unit-side pipe 110 to the respective indoor-unit-side pipes 120, 130 and 140 to distribute the refrigerant from the former to the latter; a main unit 150 for storing the pipe unit 2 therein; and, an electric component box 3 including a controller for controlling the electric parts that are mounted on the pipe unit 2.

The refrigerant distribution unit 15 is horizontally fixed to and hanged from an indoor attic or the like by multiple pieces of ceiling hanging metal fittings 62. And, in order to adjust to the environment of the attic which is liable to be hot and humid, especially, the inside of the main unit 150 has an insulating property which can prevent it against the influence of temperature variations and also the inside is sealed in order to prevent it against the influence of humidity.

Figure 3:
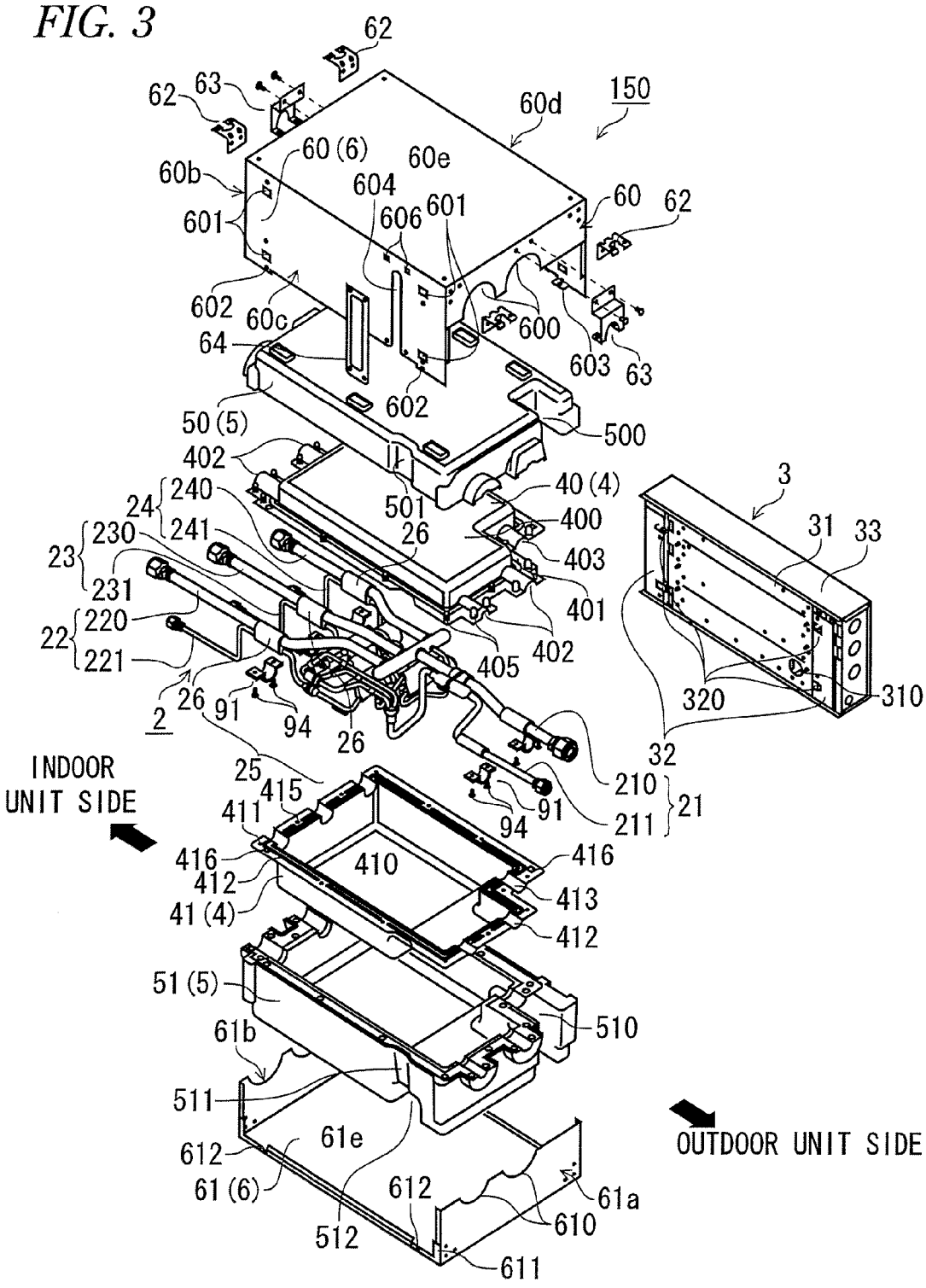
FIG. 3 is an exploded view showing the refrigerant distribution unit.
Figure 4:
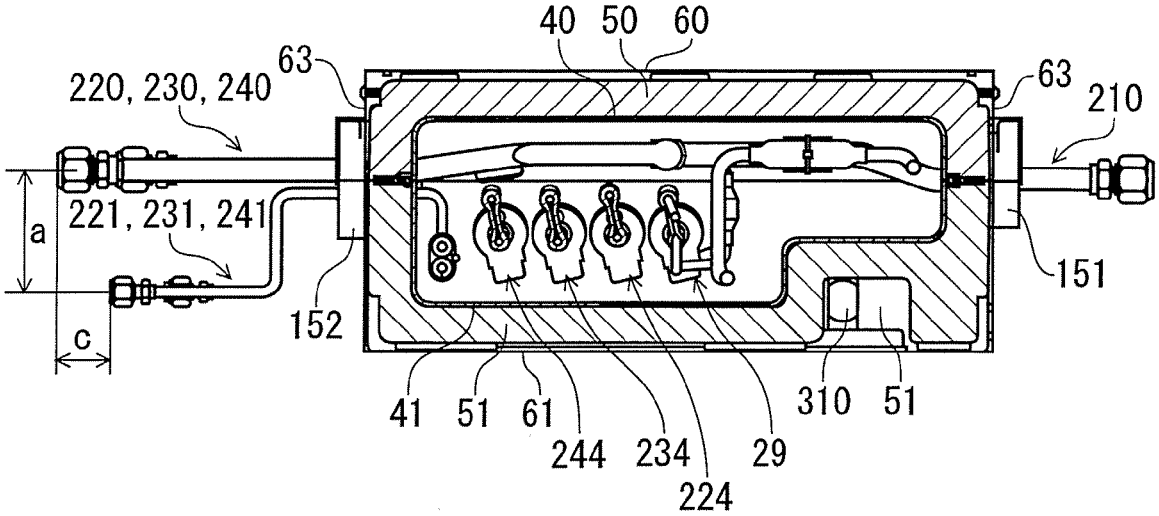
FIG. 4 is a section view showing the refrigerant distribution unit.

The pipe unit 2 shown in FIGS. 2 to 4 includes a refrigerant pipe 21 to be connected to the outdoor-unit-side pipe 110, a distribution portion 25 to be stored into the main unit 150, and branch refrigerant pipes 22, 23 and 24 respectively to be connected to their associated indoor-unit-side pipes 120, 130 and 140.

The refrigerant pipe 21 includes a gas pipe 210 and a liquid pipe 211. The gas pipe 210 includes a gas pipe joint 212 in the vicinity of the refrigerant distribution unit 15, while the liquid pipe 211 includes a liquid pipe joint 213 in the vicinity of the refrigerant distribution unit 15. Due to provision of the gas pipe joint 212 and the liquid pipe joint 213, the gas pipe 210 and the liquid pipe 211 can be connected to and removed from the outdoor-unit-side pipe 110.

The gas pipe 210 and the liquid pipe 211 are arranged horizontally and are spaced 40 mm or more from each other, while the gas pipe 210 and the liquid pipe 211 can be stored into the main unit 150 from a refrigerant pipe receiving portion 151.

The branch refrigerant pipes 22, 23 and 24 include branch gas pipes 220, 230, 240 and branch liquid pipes 221, 231, 241, respectively. The branch gas pipes 220, 230, 240 include branch gas pipe joints 222, 232, 242 in the vicinity of the refrigerant distribution unit 15, respectively; and the branch liquid pipes 221, 231, 241 include branch liquid pipe joints 223, 233, 243 in the vicinity of the refrigerant distribution unit 15, respectively. Due to provision of the branch gas pipe joints 222, 232, 242 and the branch liquid pipe joints 223, 233, 243, the branch refrigerant pipes 22, 23 and 24 can be connected to and removed from the indoor-unit-side pipes 120, 130 and 140, respectively.

The branch gas pipes 220, 230, 240 are respectively formed to have a linear shape. The branch liquid pipes 221, 231, 241 are respectively disposed downwardly of and spaced a given distance from the branch gas pipes 220, 230, 240, and are bent upwardly on the near side of the main unit 150; after then, the pipes are respectively bundled together by their associated rubber bushes 26 such that the branch gas pipe 220 and branch liquid pipe 221 are formed into a unified body, the branch gas pipe 230 and the branch liquid pipe 231 are formed into a unified body, and the branch gas pipe 240 and the branch liquid pipe 241 are formed into a unified body. Also, the branch refrigerant pipes 22, 23 and 24 are arranged horizontally and are spaced 40 mm or more from each other, while the branch refrigerant pipes 22, 23 and 24 can be stored into the main unit 150 from a branch refrigerant pipe receiving portion 152.

<Distribution Portion>

Figure 5:
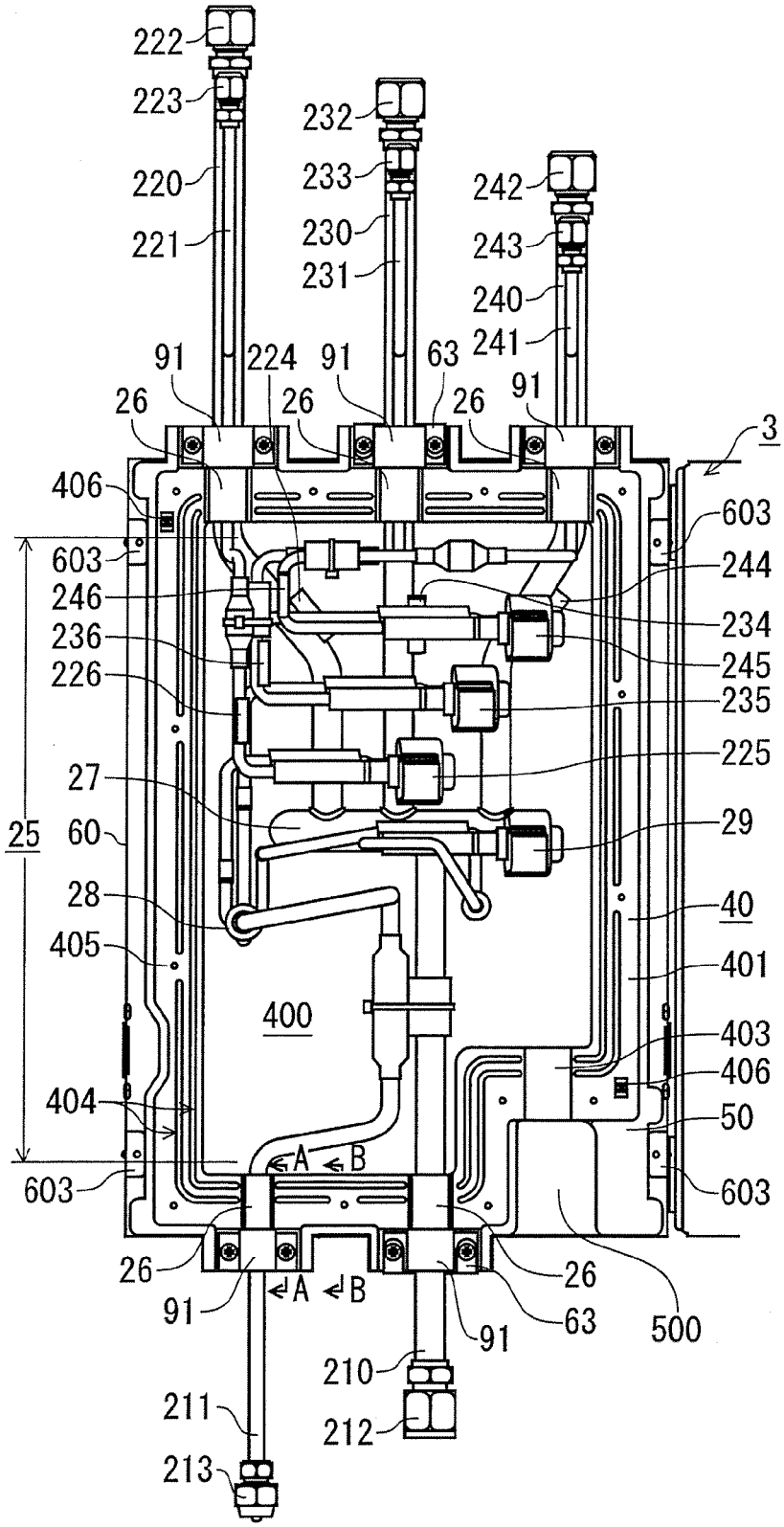
FIG. 5 is an internal structure view showing the refrigerant distribution unit.

FIG. 5 is a structure view showing the internal portion of the refrigerant distribution unit 15, showing a state in which the lower parts (which will be discussed later) of the main unit 150 are removed therefrom. The distribution portion 25 of the pipe unit 2 includes: a branch pipe 27 which makes the gas pipe 210 branch to the branch gas pipes 220, 230 and 240; branch gas pipe temperature sensors 224, 234 and 244 provided on the branch gas pipes 220, 230 and 240 respectively; a shunt 28 for diverging the refrigerant of the liquid pipe 211 to the branch liquid pipes 221, 231 and 241; electronic expansion valves 225, 235 and 245 respectively for adjusting amounts of the refrigerants flowing through their associated branch liquid pipes 221, 231 and 241; branch liquid pipe temperature sensors 226, 236 and 246 which are disposed nearer to the indoor units 12, 13 and 14 than the electronic expansion valves 225, 235 and 245 respectively; and, an on-off valve 29 for bypassing the refrigerant from the branch pipe 27 to the shunt 28.

To the branch gas pipe temperature sensors 224, 234 and 244 and the branch liquid pipe temperature sensors 226, 236 and 246, there are connected signal lines which are used to transmit the detected results of the sensors to the control substrate 30 of the electric component box 3. To the electronic expansion valves 225, 235 and 245 as well as to the on-off valve 29, there are connected wires which are used to drive the valves respectively. The signal lines and the wires are bundled together to provide a cable 80, while the cable 80 is connected to the control substrate 30 of the electric component box 3.

<Main Unit>

The main unit 150 shown in FIG. 3 is structured such that the pipe unit 2 can be held or covered by a seal case 4, an insulator case 5 and a case 6 which are arranged sequentially in this order from inside.

<Seal Case>

The seal case 4 is formed of synthetic resin and includes an upper seal case 40 and a lower seal case 41 which are divided vertically along the centers of pipe diameters of the horizontally extending refrigerant pipe 21 and the branch refrigerant pipes 22, 23 and 24.

The upper seal case 40 shown in FIGS. 3 and 5 includes a storage portion 400 for storing therein the branch portion 25 of the pipe unit 2, and an edge portion 401 formed on a periphery of the storage portion 400 for keeping seal property of the upper seal case 40.

In the edge portion 401, specifically, from the refrigerant pipe receiving portion 151 for receiving the refrigerant pipe 21 and also from the branch refrigerant pipe receiving portion 152 for receiving the branch refrigerant pipes 22, 23, 24, there are extended pipe mounting portions 402 which respectively draw such a semi-circular shape as to fit the pipes. On the right and left end portions of the pipe mounting portion 402, there are erected anchors 405 onto which screws (which will be discussed later) are mounted.

Also, a cable draw-out portion 403, which is used to draw out the cable (not shown), is also formed to have a semi-circular shape. Further, in the edge portion 401, there are provided projecting ribs 404 which extend in two lines in such a manner as to surround the storage portion 400. Insulating seals 44 are bonded on the projecting ribs 404, respectively (see FIG. 8).

Of the two-lined projecting ribs 404, the projecting rib 404 disposed outside includes the anchors 405 which are respectively erected and are spaced from each other for receiving screws (which will be discussed later). The anchors 405 are further provided erectly on four corners of the edge portion 401 as well.

The lower seal case 41 shown in FIG. 3 includes a storage portion 410 for storing therein the distribution portion 25 of the pipe unit 2, and an edge portion 411 which is formed on a periphery of the storage portion 410 and is used to keep sealing property of the lower seal case 41.

In the edge portion 411, specifically, in such portions of the edge portion 411 as are to be contacted with the refrigerant pipe 21 and the branch refrigerant pipes 22, 23, 24, there are formed pipe mounting portions 412 which respectively have a semi-circular shape; and also, there are formed cable draw-out portions 413 which respectively have a semi-circular shape and are used to draw out the cable 80. Also, in the edge portion 411, there are formed recessed ribs 412 which are used to receive the projecting ribs 404, respectively. Further, there are formed screw holes 415 which can be screwed with their associated anchors 405.

<Insulator Case>

The insulator case 5 is formed of highly heat-resisting styrene foam and has a constant thickness over the entire area thereof in order to enhance its heat-resisting property.

Referring to the structure of the insulator case 5 shown in FIG. 3, such portions thereof as correspond to the refrigerant pipe receiving portion 151 and branch refrigerant pipe receiving portion 152 are respectively projected out in a cylindrical manner; and, the insulator case 5 is divided into an upper insulator case 50 and a lower insulator case 51 along the centers of the pipe diameters of the refrigerant pipe 21 and branch refrigerant pipes 22, 23 and 24.

The upper insulator case 50 is structured such that the shape of the inside thereof is formed to fit the outer shape of the upper seal case 40. Also, the upper insulator case 50 includes a cable draw-out recessed portion 500 the shape of which is formed to fit the cable draw-out portion 403 of the upper seal case 40. And, in the left side surface of the upper insulator case 50, when it is viewed from the outdoor unit side, there is formed a cable side surface recessed portion 501 which is used to introduce the drawn-out cable 80 into the electric component box 3.

In the case of the lower insulator case 51, the shape of the inside thereof is formed to fit the outer shape of the lower seal case 41. Also, the lower insulator case 51 includes a cable draw-out recessed portion 510 the shape of which is formed to fit the cable draw-out portion 413 of the lower seal case 41. And, in the left side surface of the lower insulator case 51, when it is viewed from the outdoor unit side, there is formed a cable side surface recessed portion 511 which is used to introduce the cable 80, after it is drawn out, into the electric component box 3. Further, in the bottom surface of the lower insulator case 51, there is formed a bottom surface recessed portion 512 for the cable. The cable bottom surface recessed portion 512 is formed to cross the bottom surface of the lower insulator case 51 in such a manner that the cable bottom surface recessed portion 512 can connect together a first draw-out slot 604 and a second draw-out slot 605 which are respectively formed in the lower case 51 and also which will be discussed later.

<Case>

The case 6, which constitutes a contour of the main unit 150, can be formed by bending a metal sheet. And, the case 6 includes an upper case 60 and a lower case 61.

The upper case 60 shown in FIG. 3 has a box-like shape. Specifically, the upper case 60 includes an outdoor-unit-side wall 60*a*, an indoor-unit-side wall 60*b* which is disposed opposed to the outdoor-unit-side wall 60*a*, a first wall 60*c* disposed on the left when the upper case 60 is viewed from the outdoor unit 11 side, a second wall 60*d* which is situated on the right and is disposed opposed to the first wall 60*c*, and a ceiling surface portion 60*e*.

The outdoor-unit-side wall 60*a* and indoor-unit-side wall 60*b* respectively include upper insulator receiving portions 600 which are formed by cutting out the walls 60*a* and 60*b* in a semi-circular shape to fit the cylindrical shape of the upper insulator case 50 and each of which has such a length as extends to the centers of the pipe diameters of the refrigerant pipe 21 and the branch refrigerant pipes 22, 23 and 24. And, in the right and left end portions of the walls 60*a* and 60*b*, there are formed screw holes into which there can be screwed with the ceiling hanging metal fittings 62 for hanging down the refrigerant branch unit 2 from the ceiling; and, in the central portions of the walls 60*a* and 60*b*, there are formed screw holes into which there can be screwed with pipe hanging metal fittings 63 (which will be discussed later).

The first wall 60*c* and the second wall 60*d* respectively have such a length as reaches the bottom surface of the main unit; and, The first wall 60*c* and the second wall 60*d* respectively include, at the four upper and lower portions of the right and left end portions thereof, electric component box securing holes 601 into which there can be engaged their associated electric component box securing pawls 320 (hereinafter described as securing pawls 320, which will be discussed later) to thereby mount the electric component box 3 onto the case 6. Downwardly of the positions of the electric component box securing holes 601 formed in the lower portions of the right and left ends portions, there are provided dowels 602 which can be removably secured to dowel holes 612 (which will be discussed later). Also, downwardly of the dowels 602, there are formed screw mounting portions 603 which are extended up to the bottom surface of the case 6.

Figure 6:
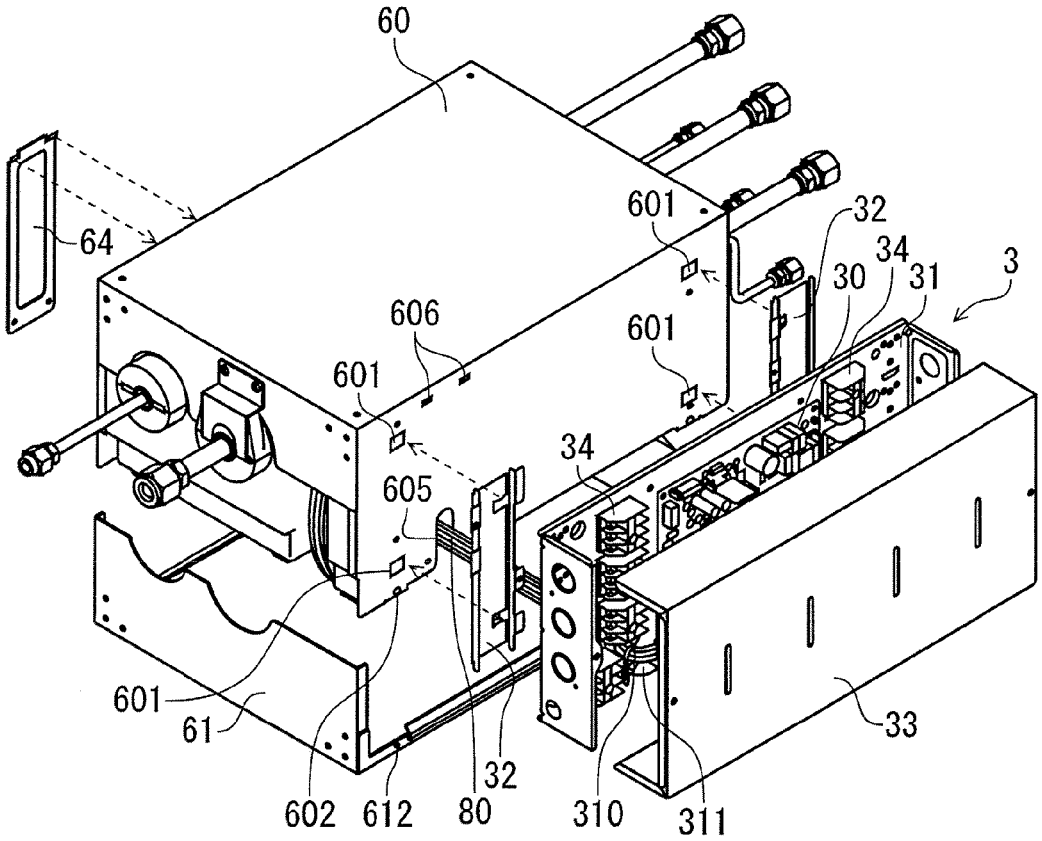
FIG. 6 is an exploded view showing a lower case and an electric component box included in the refrigerant distribution unit.

In the first wall 60*c*, there is formed a first cable draw-out slot 604 constituted of a cut-out groove which exists on the outdoor unit side and extends up to a vicinity of the ceiling surface of the case 6; and, in the second wall 60*d* shown in FIG. 6, there is formed a second cable draw-out slot 605 constituted of a cut-out groove which exists on the outdoor unit side and extends up to a middle portion of the wall 60*d*.

In such portions of the first and second walls 60*c* and 60*d* as exist near to the ceiling surface 60*e* and in the vicinity of the first and second cable draw-out slots 604 and 605, there are formed cable draw-out slot cover holes 606 to which cable draw-out slot covers 64 (which will be discussed later) can be secured.

The lower case 61 has a U-like shape and includes an outdoor-unit-side wall 61*a*, an indoor-unit-side wall 61*b*, and a bottom surface portion 61*e*.

The outdoor-unit-side wall 61*a* and indoor-unit-side wall 61*b* respectively include upper insulator receiving portions 610 which are formed by cutting out the respective portions 61*a* and 61*b* in a semi-circular shape to fit the cylindrical shape of the lower insulator case 51 and also which respectively have a length reaching the centers of the pipe diameters of the refrigerant pipe 21 and the branch refrigerant pipes 22, 23 and 24.

A metal plate, which is used to form the lower case 61, includes flange portions 611 which are formed by extending two end portions of the bottom surface portion 61*e*, bending the end portions, and spot welding the end portions to their associated outdoor-unit-side wall 61*a* and the indoor-unit-side wall 61*b*.

The flange portions 611 respectively include dowel holes 612 to which, when the lower case 61 is assembled, there can be removably secured their associated dowels 602. In such portions of the bottom surface portion 61*e* as exist near to the dowel holes 612, there are formed screw holes.

<Electric Component Box>

The electric component box 3 shown in FIGS. 3 and 6 includes a control substrate 30 for controlling the refrigerant distribution unit 15, an electric component box main body 31, two electric component box mounting plates 32 (hereinafter described as mounting plates 32), and an electric component box cover 33.

The electric component box main body 31 is constituted of a metal plate having a U-like shape; and, within the U-like shape, there are disposed the control plate 30 and multiple terminal bases 34. In a portion of the electric component box main body 31, there is formed a cable guide hole 310 which is used to guide the cable 80; and, in such inside portion of the electric component box main body 31 as exists near to the cable guide hole 310, there is provided a cable guide 311 which is used to connect the cable 80 to the electric component box main body 31 and guide the cable 80 to the control substrate 30.

The mounting plates 32 respectively have a rectangular shape, include electric component box securing pawls 320 (securing pawls 320) so formed in the two upper and lower portions thereof as to be bent inwardly symmetrically, and are welded to the two right and left portions of the outside of the electric component box main body 31.

<Assembling Method>

The refrigerant distribution unit 15 may be assembled in such a manner that, when compared with its installing state where it is hanged down from the ceiling, it is turned upside down. Specifically, firstly, the upper case 60 is placed with its ceiling surface portion 60*e* facing downward and then the upper insulator case 50 is superimposed on top of the inside of the upper case 60. The upper insulator case 50 is supported by the insulator receiving portion 600 of the upper case 60.

Figure 7:
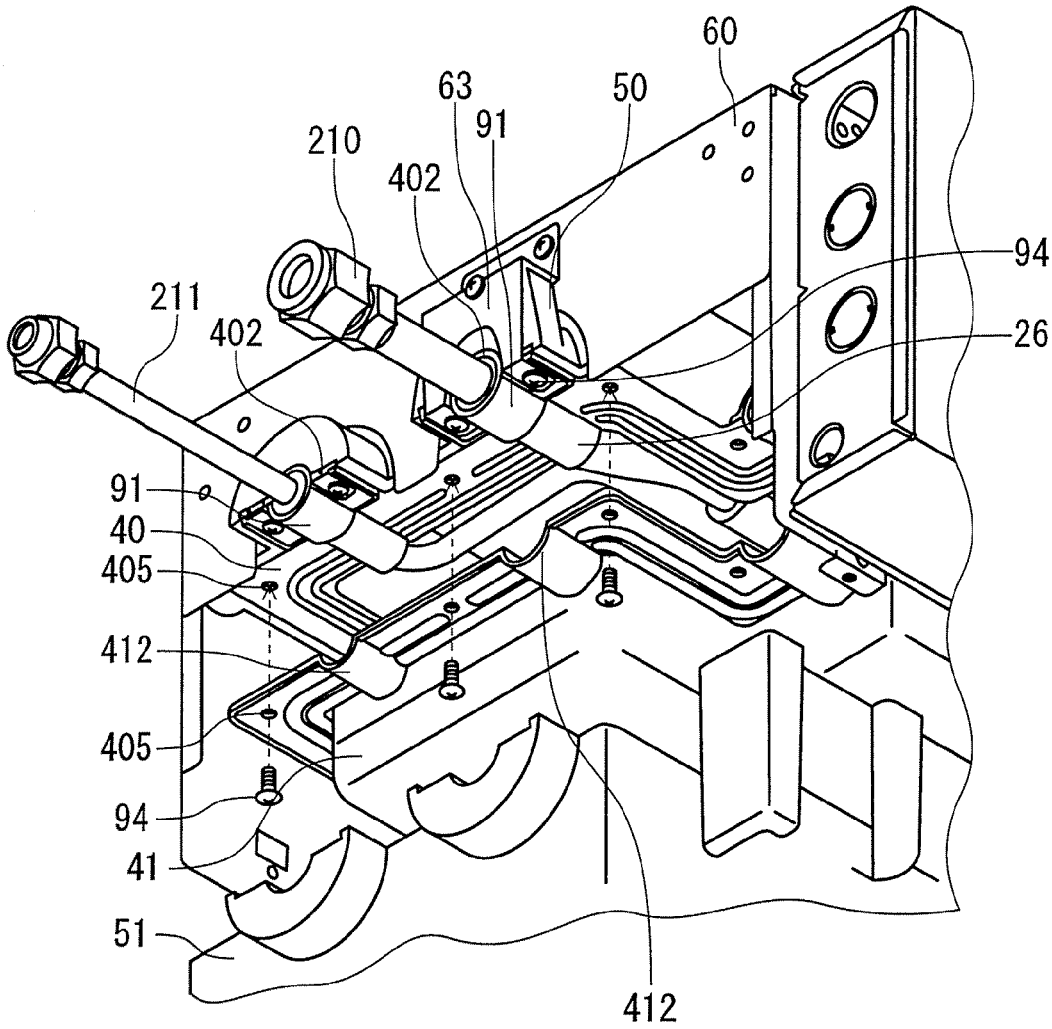
FIG. 7 is a detail view showing a refrigerant pipe receiving portion included in the refrigerant distribution unit.

Next, as shown in FIGS. 3, 5 and 7, the upper seal case 40 is fitted into the upper insulator case 50. And, such portions of the gas pipe 210, the liquid pipe 211 and the branch refrigerant pipes 22, 23, 24 of the pipe unit 2 as are wound by their associated rubber bushes 26 are fitted into the pipe mounting portions 402 of the upper case 40, and pipe holders 91 are fastened and fixed to the pipe mounting portions 402 from above the rubber bushes 26 using screws 94.

Figure 8:
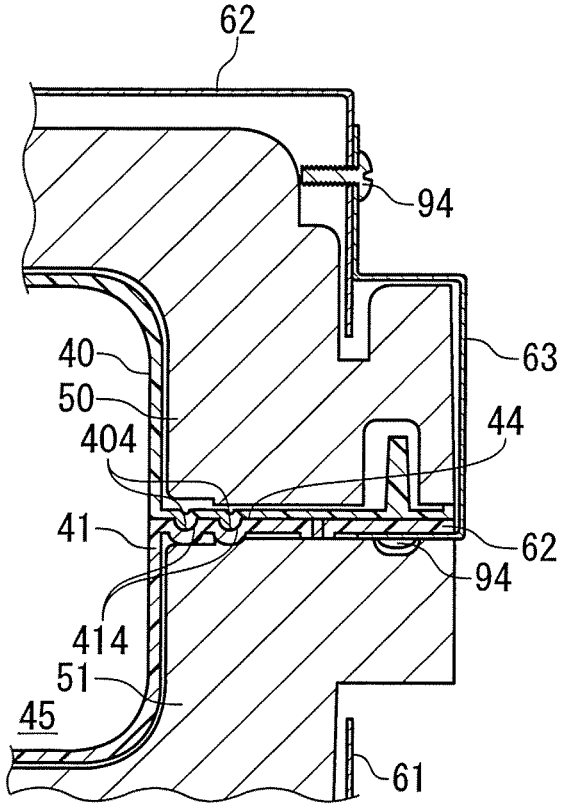
FIG. 8 is a section view showing the refrigerant distribution unit taken along the A-A line shown in FIG. 5.

Next, as shown in FIGS. 7 and 8, for the gas pipe 210 and the pipe mounting portion 402 of the branch refrigerant pipe 23, a pipe hanging metal fitting 63 with its upper end engaged with the upper case 60 is so provided as to extend over the upper insulator case 50 down to the lower end portion of the pipe holder 91. And, the pipe hanging metal fitting 63 and the pipe holder 91 are fastened together with the screws and are then fixed to the upper seal case 40.

The cables 80 are bundled together by a binding tool 82 and are drawn out to the outside from the cable receiving portion 403 of the upper seal case 40.

According to this structure, since the pipe unit 2 is fixed to the upper seal case 40 by the pipe hanging metal fitting 63, after the refrigerant distribution unit 15 is installed in such a manner that the refrigerant distribution unit 15 is hanged down from the ceiling, maintenance on the pipes, electronic expansion valves and the like disposed within the refrigerant distribution unit 15 can be carried out in the following manner. That is, simply by removing the lower case 61, lower insulator case 51 and lower seal case 41, the pipe unit 2 can be exposed to the outside, thereby being able to carry out maintenance on the pipe unit 2 without taking the refrigerant distribution unit 15 to pieces.

Figure 9:
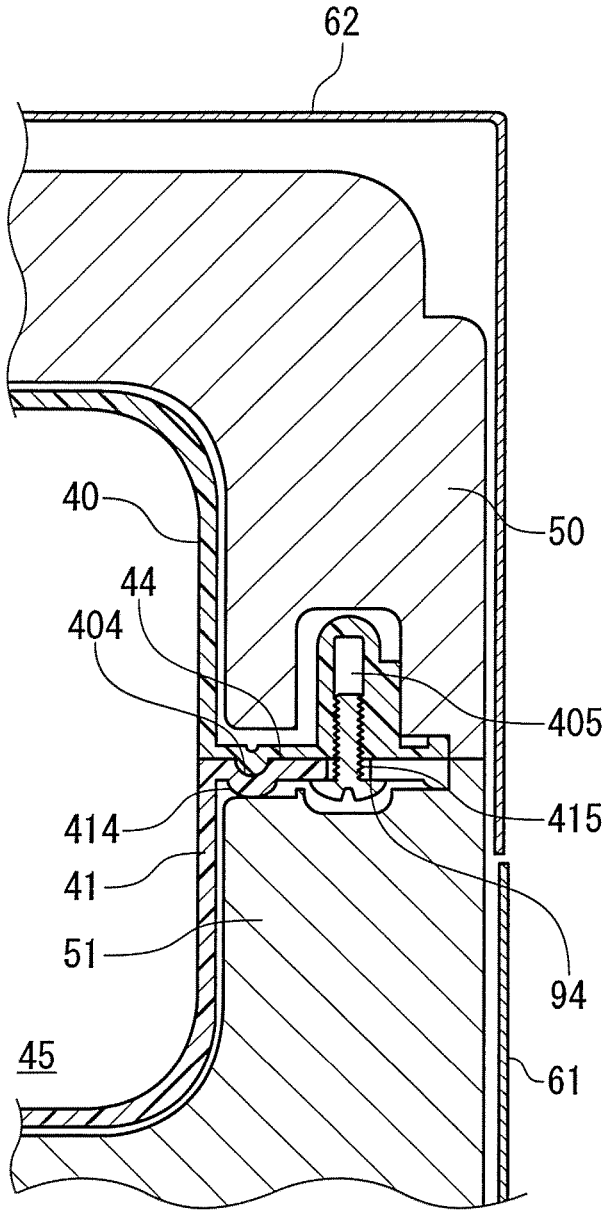
FIG. 9 is a section view showing the refrigerant distribution unit taken along the B-B line shown in FIG. 5.

Next, the seal case securing hole 416 of the lower seal case 41 is inserted in such a manner that the hole can be engaged with the seal case securing pawl 406 projected from the upper seal case 40. In the case that the upper and lower seal cases 40 and 41 are engaged with each other, as shown in FIG. 9, the recessed rib 414 of the lower seal case 41 is closely contacted with the projecting rib 404 of the upper seal case 40 through an insulating seal 44 with no clearance between the ribs 404 and 414. Next, the screws 94 are fastened through screw holes 415 with their associated anchors 405 which are respectively provided in the multiple portions of the edge portion 401.

As shown in FIG. 7, the pipe mounting portion 412 of the lower seal case 41 is structured such that the pipe mounting portion 412 can be fitted with the rubber bushes 26 of the gas pipe 210 and the liquid pipe 211 respectively stored in the upper seal case 40 but is prevented from covering the pipe mounting portion 402 of the upper seal case 40. Accordingly, the upper and lower seal cases 40 and 41 are superimposed on top of each other with no clearance between them, whereby the interior portion of the seal case can be kept hermetically sealed.

Owing to the hermetically sealed state of the interior portion of the seal case, the pipe unit 2 is prevented from touching the air, thereby being able to prevent drain water from being generated.

Next, the lower insulator case 51 is placed on top of the lower seal case 41. In this case, besides the lower insulator case 51, the screws 94, which have been engaged with the pipe holder 91 and pipe hanging metal fitting 63, are also covered with the lower insulator case 51. This can also prevent water or like from touching the screws 94.

Figure 10A:
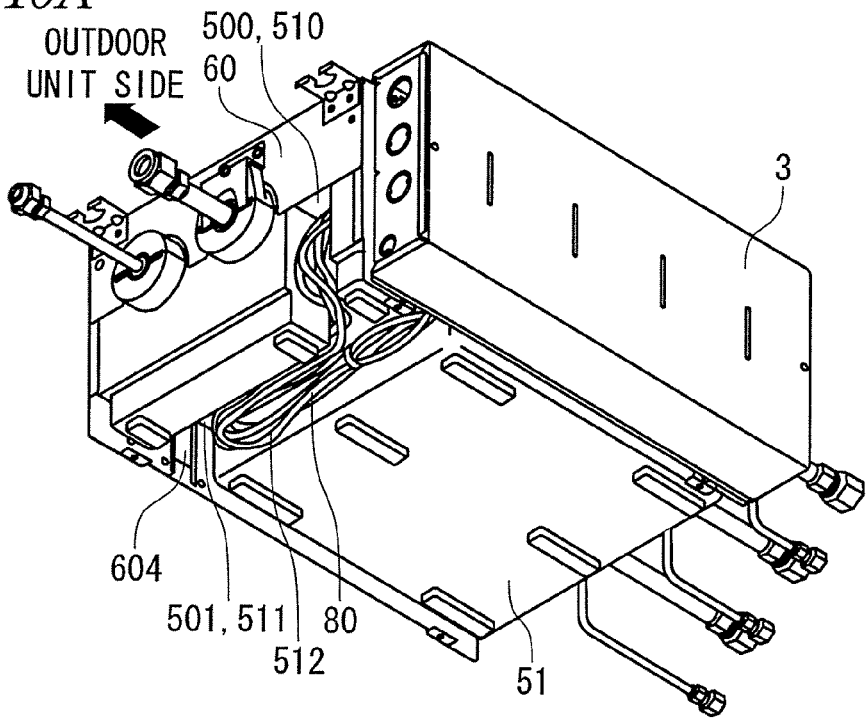
FIG. 10A is a view showing the electric component box when it is viewed from below.
Figure 10B:
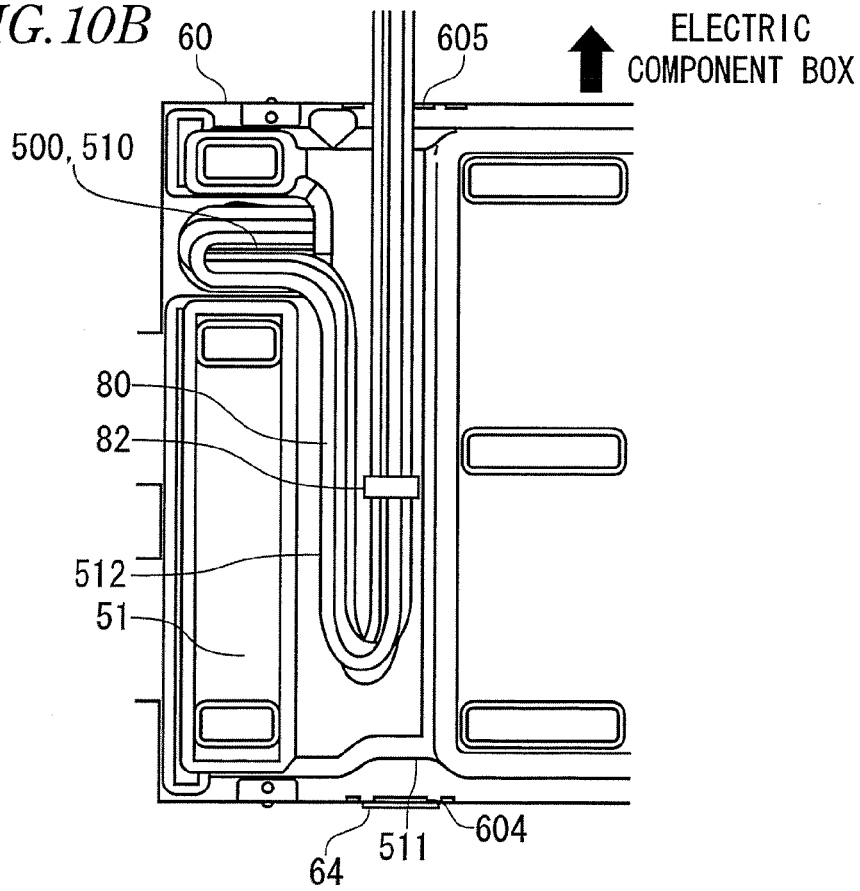
FIG. 10B is a bottom view thereof.

The electric component box 3 may be mounted onto any of the first and second walls 60*c* and 60*d* of the upper case 60. When mounting the electric component box 3 onto the second wall 60*d* which is the right lateral surface when viewed from the outdoor unit 11 side, as shown in FIGS. 10A and 10B, the cable 80 is guided along the draw-out recessed portion 500 of the upper insulator case and the draw-out recessed portion 510 of the lower insulator case to the cable bottom surface recessed portion 512. The cable 80, which has been guided to the cable bottom surface recessed portion 512, is turned back at the cable bottom surface recessed portion 512 and is drawn out from the second cable draw-out slot 605 to the outside of the main unit 150. The thus drawn-out cable 80, as shown in FIG. 6, is guided from the cable guide hole 310 of the electric component box main body 31 into the electric component box 3, is bundled to the electric component box main body 31 by the cable guide 311, and is then connected to multiple connectors (not shown) which are provided on the control substrate 30 of the electric component box 3. The electric component box main body 31, which has been connected to the cable 80, inserts the securing pawl 320 of the mounting plate 32 welded to the electric component box main body 31 into the electric component box securing hole 601 of the upper case 60. In this case, the securing pawl 320, specifically, the upper pawl thereof is held in a state where it is hanging down, whereby the electric component box 3 is provisionally fixed by the securing pawl 320. Next, the electric component box 3 is engaged from inside of the electric component box main body 31 into the upper case 60 using screws. As a result, the electric component box 3, which is provisionally fixed by the securing pawl 320, is fixed. Then, the electric component box cover 33 is placed on top of the electric component box 3.

Figure 11A:
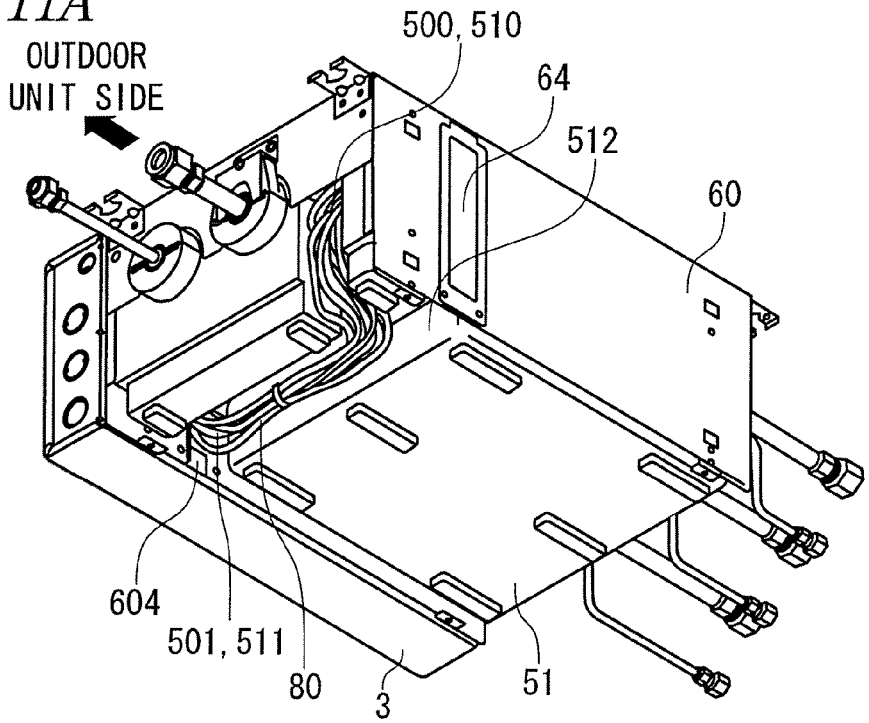
FIG. 11A is a view of the electric component box when it is viewed from below.
Figure 11B:
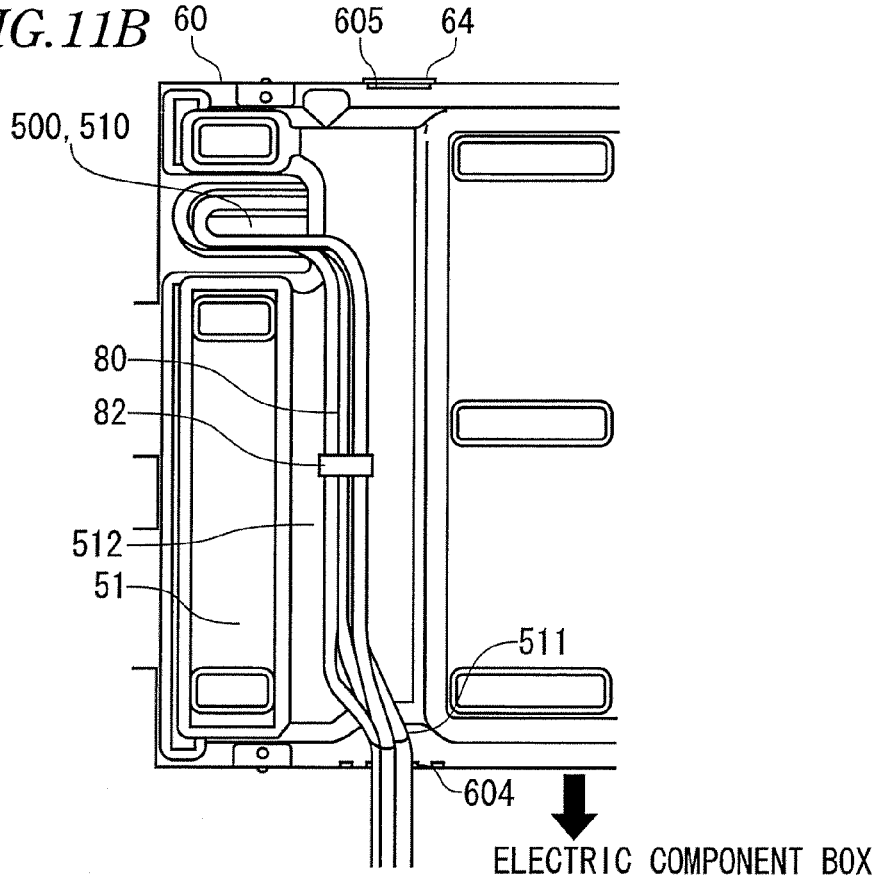
FIG. 11B is a bottom view thereof.

Also, as shown in FIGS. 11A and 11B, when mounting the electric component box 3 onto the first wall 60*c* which is situated on the left when the upper case 60 is viewed from the outdoor unit side, the electric component box main body 31 is turned upside down and the securing pawl 320 of the mounting plate 32 is inserted into the securing hole 601 of the upper case 6. Since the electric component box main body 31 is turned upside down, the cable guide hole 310 is moved to the ceiling side.

The cable 80, which has been guided to the cable bottom surface recessed portion 512, is moved over the cable bottom surface recessed portion 512, is moved along the cable side surface recessed portions 501, 511, is drawn out from above the first cable draw-out slot 604 to the outside of the main unit 150, and is guided from the cable guide hole 310 of the electric component box main body 31 into the electric component box 3.

According to this mounting method, for example, even when moving the electric component box 3 from one place to the other according to the site where the refrigerant distribution unit 15 is installed, the electric component box 3 can be moved simply with the cable 80 remaining connected.

Next, a cable draw-out slot cover 64 is mounted onto any one of the first cable draw-out slot 604 and the second cable draw-out slot 605 which are formed in the portion of the upper case 60 where the electric component box 3 is not installed. Since the cable draw-out slot cover 64 is formed longer than the cable draw-out slot 604, and also since cable draw-out cover holes 606 are formed at the symmetric positions of the first and second walls 60*c* and 60*d*, the cable draw-out slot cover 64 can be mounted onto any one of these surface portions. The upper pawls of the cable draw-out slot cover 64 are secured to the cable draw-out slot cover holes 606, and then the cable draw-out slot cover 64 is engaged with the upper case 60 using screws. This structure can hide the cable draw-out cover holes 606 from the outside. Therefore, an appearance of the upper case can be enhanced and also an invasion of dust into the inside of the upper case can be prevented.

Next, the lower case 61 is assembled to the upper case 60. In this case, the dowel 602 provided on the upper case 60 is secured to a dowel hole 612 formed in the lower case 61, thereby fixing the lower case 61 provisionally. Next, the screws 94 are engaged with the screw mounting portion 603 of the bottom surface 61*e* of the upper case 60 to thereby fix the upper case 60 and lower case 61 to each other.

When carrying out maintenance on the pipe unit 2, the screws 94 engaged with the screw mounting portion 603 are removed. In this case, even when the screws 94 are removed, the lower case 61 is fixed provisionally because of engagement of the dowel 602 into the dowel hole 612. Therefore, there is no fear that the lower case 61 can fall down unexpectedly.

Since the lower case 61 can be provisionally fixed to the upper case due to the engagement of the dowel hole 612 with the dowel 602, it is possible to provide a provisionally fixing function without using new parts.

As has been described heretofore, according to the exemplary embodiment, since the installation surface of the electric component box 3 can be changed while the main unit 150 and cable 80 remain connected to each other, the efficiency of the installation operation of the refrigerant distribution unit 15 can be enhanced. Also, after installed, since the cable 80 is stored within the refrigerant distribution unit main unit, there is no possibility that an operator can touch the cable 80, thereby being able to provide a refrigerant distribution unit for an air conditioner which can secure the safety of the operator.

While the present inventive concept has been shown and described with reference to certain exemplary embodiments thereof, it will be understood by those skilled in the art that various changes in form and details may be made therein without departing from the spirit and scope of the invention as defined by the appended claims.

What is claimed is:

1. A refrigerant distribution unit for an air conditioner, comprising:

a pipe unit which distributes a refrigerant from a refrigerant pipe to a plurality of branch refrigerant pipes, the refrigerant pipe being configured to connect to an outdoor unit and the plurality of branch refrigerant pipes being configured to connect to indoor units, each of the plurality of branch refrigerant pipes including an electronic valve and a temperature sensor;

a main unit that includes an insulator case, an upper case, and a lower case, the main unit storing the pipe unit in such a manner that the pipe unit is at least partially within the insulator case, which is at least partially surrounded by the upper case and the lower case; and an electric component box which controls the electronic valves and the temperature sensors by connecting the electronic valves with the temperature sensors by cables, wherein the insulator case includes a side face where a refrigerant pipe receiving portion for connecting the refrigerant pipe is formed and a side face where a branch refrigerant pipe receiving portion for connecting the plurality of branch refrigerant pipes is formed, wherein a cable draw-out recessed portion for drawing out the cables from the pipe unit is formed in one of the side faces of the insulator case where the refrigerant pipe receiving portion and the branch refrigerant pipe receiving portion are formed, and a bottom surface recessed portion for storing the cables is formed in a bottom surface of the insulator case, and wherein the upper case includes a first cable draw-out slot formed in a first side face and a second cable draw-out slot formed in a second side face for selectively guiding the cables from the bottom surface recessed portion to a cable guide hole formed in the electric component box, the first and second side faces of the upper case being different from the side faces where the refrigerant pipe receiving portion and the branch refrigerant pipe receiving portion are formed.

2. The refrigerant distribution unit according to claim 1, wherein a mounting surface upon which the electric component box is mounted is changeable by removing the lower case, turning the electric component box upside down while maintaining a connection of the electric component box to the cables, and securing the electric component box to one of the first side face and the second side face of the upper case using securing means respectively formed on the first side face and the second side face of the upper case.

3. The refrigerant distribution unit according to claim 2, wherein the first cable draw-out slot is formed of a cut-out groove extending to a vicinity of a ceiling surface of the refrigerant distribution unit, and the second cable draw-out slot is formed of a cut-out groove having the same height as the bottom surface recessed portion.

4. The refrigerant distribution unit according to claim 3, wherein the insulator case includes a side recessed portion existing on a side of the first cable draw-out slot, and wherein, when the electric component box is mounted onto a side where the first cable draw-out slot is formed, the cables are drawn out from the draw-out recessed portion of the insulator case and are arranged to extend through the bottom surface recessed portion and along the side recessed portion to the cable guide hole from the first cable draw-out slot.

* * * * *